US009290902B2

(12) United States Patent
Schalley

(10) Patent No.: US 9,290,902 B2
(45) Date of Patent: Mar. 22, 2016

(54) MOBILE DRY SETTING ELEMENT AND INSTALLATION, PROCESS FOR USING SAME AND USE THEREOF

(71) Applicant: Belbridge BvBa, Erembodegem (BE)

(72) Inventor: Wim Schalley, Grimbergen (BE)

(73) Assignee: BELBRIDGE BVBA, Erembodegem (BE)

( * ) Notice: Subject to any disclaimer, the term of this patent is extended or adjusted under 35 U.S.C. 154(b) by 0 days.

(21) Appl. No.: 13/893,852

(22) Filed: May 14, 2013

(65) Prior Publication Data

US 2014/0119830 A1 May 1, 2014

(30) Foreign Application Priority Data

Oct. 26, 2012 (GB) ..... 1219282.9

(51) Int. Cl.
*E02D 19/04* (2006.01)
*E02D 19/00* (2006.01)
*E02D 31/04* (2006.01)

(52) U.S. Cl.
CPC ..... *E02D 19/00* (2013.01); *E02D 31/04* (2013.01)

(58) Field of Classification Search
CPC ..... E02D 19/00; E02D 19/04
USPC ..... 405/11, 14
See application file for complete search history.

(56) References Cited

U.S. PATENT DOCUMENTS

| | | | | |
|---|---|---|---|---|
| 5,292,206 | A | 3/1994 | Sonck et al. | |
| 5,324,140 | A | 6/1994 | Lopez et al. | |
| 2010/0189503 | A1 * | 7/2010 | Burkhardt | 405/14 |

FOREIGN PATENT DOCUMENTS

| | | |
|---|---|---|
| EP | 2163692 | 3/2010 |
| GB | 2046818 | 11/1980 |
| GB | 2114636 | 8/1983 |
| GB | 2226843 | 11/1990 |

* cited by examiner

*Primary Examiner* — Tara M. Pinnock
(74) *Attorney, Agent, or Firm* — Duane Morris LLP; Gregory M. Lefkowitz; Karen C. Kline

(57) ABSTRACT

A dry setting installation for generating a substantially dry working space for carrying out work on part of a partially submerged structure, the dry setting installation comprising a truncated elongated angular-, oval-shaped or part-angular-part-oval-dry setting element, which with the part of a partially submerged structure is capable of forming a cofferdam round the part of the partially submerged structure; and a process for the treatment of part of a partially submerged structure, the process comprising the steps of: closing the dry setting element with the part of the partially submerged structure, sealing the dry setting element on the part of the partially submerged structure; pumping out the water thereby providing a cofferdam round the part of the partially submerged structure; cleaning the surface of the part of the partially submerged structure; curing the curable adhesive coating, filling the dry setting installation with water, removing the dry setting element.

9 Claims, 2 Drawing Sheets

MOBILE DRY SETTING ELEMENT AND INSTALLATION, PROCESS FOR USING SAME AND USE THEREOF

TECHNICAL FIELD OF THE INVENTION

The present invention relates to the field of partially submerged structures. More particularly, the present invention relates to a dry setting element, a dry setting installation, a process for treatment of a partially submerged structures and the use of the mobile dry setting installation.

BACKGROUND OF THE INVENTION

Marine structures not only consist of sheet pile walls, but also isolated partially submerged hollow or solid structures for example marine structures such as piers, wharfs, drilling platforms, columns, pipes and piles, pilasters, stanchions, pylons legs, piling, and uprights and any other supporting member. The supporting members may be comprised of wood, concrete, metal beams and the like. Such partially submerged structures whether isolated or not require treatment to prevent and/or combat corrosion by salt water and/or water-borne pollution in seawater, brackish water or freshwater as well as infestation by marine organisms such as barnacles in salt water and zebra mussels in freshwater.

In order to perform maintenance or control operations on these partially submerged hollow or solid structures for example to check the level of corrosion, perform treatment against corrosion or replace or repair corroded parts of the structures, it is useful to make these structures easily accessible in a dry environment. Dry setting installations, also referred to as cofferdams or caissons, enable free access to the site in a dry environment.

U.S. Pat. No. 5,292,206 discloses a device for sealing a caisson comprising a bottom, two upright side walls and a back wall in a watertight way against a sheet pile wall having a longitudinal profile composed of a succession of grooves and ridges, said device comprising the combination of: a) an inflatable continuous air chamber extending along the bottom of the caisson over the total width of the caisson and along the upright side walls thereof to sealingly engage the ridges of the sheet pile wall while conforming to irregularities therein; b) a series of deformable sealing elements disposed along the bottom of the caisson to sealingly engage the grooves of the sheet pile wall, each having a profile approaching the profile of a groove, which elements are each mounted between two horizontal guiding plates disposed one above the other in a manner such as to allow a displacement of the elements in the direction of the sheet pile wall in front of the grooves therein, while said inflatable air chamber is provided for pressing these elements against the wall to enable the deformable sealing elements to adapt to deformed and irregular grooves; c) a core provided between each of said sealing elements and the air chamber, which core is adapted to be displaced between said guiding plates and is fixed to the adjoining sealing element; and d) means for allowing a lateral displacement of said sealing elements together with the guiding plates above and underneath these sealing elements with respect to the caisson.

EP 2163692A discloses a dry setting installation (1) for generating a substantially dry working space for carrying out work at an underwater structure, the dry setting installation (1) comprising two side-walls (2), a back wall (3), a bottom (4) and, for each side-wall, a side edge sealing means (20) provided on the side-wall edge for providing a substantially sealing contact between the side-walls (2) and the underwater structure, characterised in that the dry setting installation comprises a distance variation means (30) for varying the distance between the side edge sealing means (20) of the two side-walls (2).

GB 2114636A discloses a working chamber for use in underwater work on an underwater member, the chamber consisting of two or more chamber sections which can be locked together in contact with each other; an opening being provided at the bottom and the top of the chamber and adapted for the introduction of the member in connection with which the chamber is to be used; a sealable manhole being provided in the upper part of the chamber.

GB 2226843A discloses an apparatus for allowing work to be carried out on a foundation pile, at least part of which is submerged, comprising means for locating a work platform around the pile, the work platform being surrounded by an upwardly extending wall, means for providing a seal between the work platform and the pile, means for locating the work platform in a desired location relative to the pile whilst the seal between the work platform and the pile is being effected and means for removing any water between the surrounding wall and the pile from above the seal. In a preferred embodiment the work platform is formed in two portions, each portion of the work platform having a part-circular cut-out and a section of wall secured thereto.

GB 2046818A discloses equipment for carrying out underwater operations on the exposed head sections of foundation piles and the like, the equipment having a submergible water-free working chamber adapted to be disposed over the exposed head section, a floor near the bottom edge of the chamber, the floor having an aperture with sealing means for sealing between the head section of a foundation pile requiring attention and the floor, and the working chamber being connected to at least one shaft extending upwardly for projection beyond the water surface.

U.S. Pat. No. 5,324,140 discloses a flexible, submersible compartment which allows a user to perform repairs on submerged structures in dry conditions in the presence of rigid obstacles, said compartment comprising: a flexible diving bell adapted to be inflated so as to partially enclose a submerged structure, said flexible diving bell having an opening at an upper portion; a collar attached to said flexible bell at the opening including a seal element for sealing the opening about the submerged structure; and a lower platform-brace attached to said flexible bell comprising a plurality of interconnected modules for anchoring to the structural element, each module including a boundary member wherein the boundary members of the interconnected modules form a discontinuous ring, at least two of the modules including a boundary member having first and second pivotally interconnected segments; whereby said flexible bell when inflated, and the second segments contract upon contact with a rigid obstacle.

A major problem with maintenance of any kind is the hinder that it engenders. This is particular serious in the case of hinder to waterways and marine installations e.g. harbours, ports, bridges and oil platforms. It is important that such hinder should be reduced to a minimum. There is a therefore a need for rapidly mountable and demountable installations allowing such work to be carried out expeditiously. A further requirement is that the installation be as compact as possible both as regards limiting physical hinder during the maintenance activities and providing accessibility to isolated partially submerged structures very close to one another.

The cited prior art provides solutions to the problem of inspecting and/or repairing and/or maintaining an isolated structure by surrounding it by an installation. However, many structures are not isolated and even if isolated may not be fully surroundable with an installation.

SUMMARY OF THE INVENTION

It is an object of the present invention to provide a reusable dry setting element enabling the rapid treatment of partially submerged structures in a sort of mobile dry dock for such structures with a rapid, for example 8 hours or less, turn-around-time i.e. the time taken for the whole process of treatment from the accommodation of the partially submerged structure in the reusable dry setting element to the removal of the treated isolated structure from the reusable dry setting element at sea and in rivers, canals and harbours.

An advantage of the present invention is that maintenance is possible of inaccessible tubing, legs, pylons and piles.

Another advantage of the present invention is that the dry setting element does not need to be inflated.

Another advantage of the present invention is that the dry setting element does not need to be contracted.

Still another advantage of the present information is that it can be operated at ambient pressure.

Still another advantage of the present invention is that it does not require a panel or door to dock it to the partially submerged structure.

Still another advantage of the present invention is that in the case of a cylindrical partially submerged structure, the dry setting element can be smoothly moved round the structure to realise inspection and/or maintenance round the whole structure.

A further advantage of the present invention is that marine installations remain fully operational.

A still further advantage of the present invention is that due to the rapid turn-around-time treatment can be contemplated under circumstances which would not be contemplatable were a much longer turn-around-time be necessary for reasons of stability of the environment of the isolated element itself.

The above objective is accomplished by a dry setting element, a dry setting installation, a process for treatment of a partially submerged isolated structure and the use of the mobile dry setting installation of the present invention in which instead of fully surrounding the partially submerged structure it is possible to use a part of the structure itself to provide the closure for a dry setting element.

According to the present invention a dry setting element is provided for the in situ inspection and/or maintenance and/or repair of part of a partially submerged structure, said dry setting element being adapted to accommodate said part of said partially submerged structure by a sealing means i.e. the part of the partially submerged structure, which is the object of the inspection and/or maintenance and/or repair, itself provides the element closing the dry setting element.

According to a first aspect of the present invention a truncated elongated angular-, oval- or part-angular-part-oval-shaped dry setting element according to claim 1 is provided. The part of the partially submerged structure can have any profile e.g. elongated oval e.g. cylindrical, or an elongated angular, e.g. having an acute angle, a 90° angle or an obtuse angle, profile.

According to a second aspect of the present invention a dry setting installation (1) is provided for generating a substantially dry working space for carrying out work on part of a partially submerged structure, the dry setting installation (1) comprising a first truncated elongated angular-, oval- or part-angular-part-oval-shaped dry setting element of the first aspect of the present invention, which with said part of a partially submerged structure is capable of forming a cofferdam round said part of said partially submerged structure.

According to a third aspect of the present invention a process according to claim 5 is provided. According to a fourth aspect of the present invention it is provided the use of the mobile dry setting installation as disclosed above for carrying out maintenance on parts of partially submerged structures.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

Figure 1:
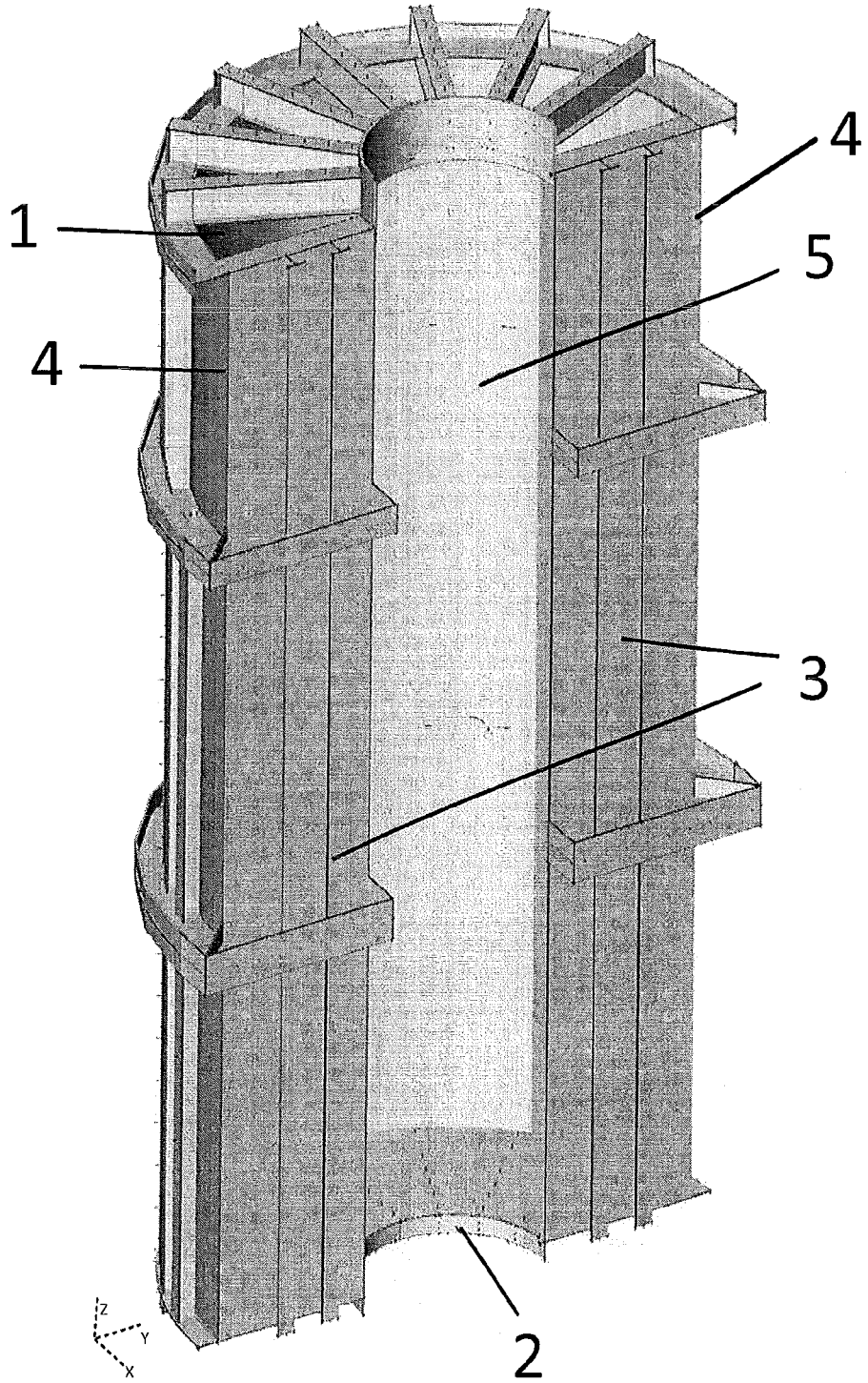
FIG. 1 shows a schematic dry setting element, according to the present invention, where 1 is the first (open) end, 2 is the second (closed) end with a floor, 3 is the sealing means closed except for an open part, 5, which is adapted to accommodate part of a partially submerged structure and 4 and 4' are the two elongated extremities of the truncated elongated angular-, oval- or part-angular-part-oval-shaped dry setting element.

In the different figures, the same reference signs refer to the same or analogous elements.

DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

The following terms are provided solely to aid in the understanding of the invention.

Definitions

The term "partially submerged structure", as used in disclosing the present invention, means a partially submerged solid or hollow structure for example a column, a pile, a pilaster, a stanchion, a pylon, an upright and a single pier. The partially submerged structure may be conductive e.g. metallic or non-conductive e.g. wood, ceramic, particularly concrete. It may be tubular, polygonal e.g. six, eight, ten or twelve-sided in cross-section.

The term "marine structure", as used in disclosing the present invention, means any structure which is partially submerged and includes the supports of bridges, oil platforms, piping.

The term "angular-shaped", as used in disclosing the present invention, mean a two-dimensional polygonal shape.

The term "oval-shaped", as used in disclosing the present invention, means a two-dimensional rounded shape and includes circular and ellipsoidal shapes.

The term "oval", as used in disclosing the present invention means a curve shaped like a section of an egg.

The term "part-angular-part-oval-shaped", as used in disclosing the present invention means a two-dimensional shape which has at least one straight or angular element and at least one curved or oval part.

The term "elongated oval-shaped", as used in disclosing the present invention, means an object with an oval profile extended in a direction substantially perpendicular to the plane of the oval e.g. at an angle between 70° and 110°, with angle between 80° and 100° being preferred.

The term "truncated elongated oval-shaped", as used in disclosing the present invention, means an object with an oval profile extended in a direction substantially perpendicular to the plane of the oval in which the oval profile has been cut off along the whole length of the object leaving two elongated extremities.

The term "sealing element", as used in disclosing the present invention, means an anything that can provide a seal including a welding point, a fastening means e.g. bolts, screws etc., and a seal e.g. a pneumatic seal, a closed cell foam sealing material, hydraulic tubing or a combination of one or more of these options.

The term "surface", as used in disclosing the present invention, means the surface of a support for the adhesive coating, the support being any material to which the adhesive coating can adhere e.g. a non-conductive support such as concrete or ceramic or a conductive support such as steel.

The expression "substantially no movement", as used in disclosing the present invention, means insufficient movement to result in water leakage.

The term "substantially planar", as used in disclosing the present invention, means at least 90% in the same plane.

The term "substantially parallel elements", as used in disclosing the present invention, means deviating from parallel by a maximum of 20°, preferably a maximum of 10°.

The invention will now be described by a detailed description of several embodiments of the invention. It is clear that other embodiments of the invention can be configured according to the knowledge of persons skilled in the art without departing from the true spirit or technical teaching of the invention, the invention being limited only by the terms of the appended claims.

Truncated Elongated Oval-Shaped Dry Setting Element

According to a first aspect of the present invention a truncated elongated angular-, oval- or part-angular-part-oval-shaped dry setting element is provided having two elongated extremities, a first end, a second end and a sealing means, said first truncated angular-, oval- or part-angular-part-oval-shaped end being open and said second truncated angular-, oval- or part-angular-part-oval-shaped end being closed with a floor having a free edge, wherein said sealing means comprises a structure extending between said elongated extremities and the free edge of said floor, said sealing means being closed except for an open part which is adapted to accommodate part of a partially submerged structure, and has sealing elements along the edges of said open part of said sealing means.

According to a preferred embodiment of the first aspect of the present invention, the dry setting element is non-inflatable.

According to another preferred embodiment of the first aspect of the present invention, the dry setting element is non-contractible e.g. to accommodate the part of the partially submerged structure.

According to another preferred embodiment of the first aspect of the present invention, the dry setting element is capable of being used at ambient pressure (i.e. atmospheric pressure).

According to still another preferred embodiment of the first aspect of the present invention, the sealing means 3 closed except for an open part 5 which is adapted to accommodate part of a partially submerged structure P is the plane formed by the elongated edges 4 and 4', as shown in FIG. 1, or the closed parts thereof being external to the plane formed by the elongated edges 4 and 4' and each at an angle of less than 60° (with less than 45° being preferred and less than 30° being particularly preferred) thereto.

FIG. 1 shows a schematic of a dry setting element, according to the present invention, where 1 is the first (open) end, 2 is the second (closed) end with a floor, 3 is the sealing means closed except for an open part, 5, which is adapted to accommodate part of a partially submerged structure P and 4 and 4' are the two elongated extremities of the truncated elongated angular-, oval- or part-angular-part-oval-shaped dry setting element.

Figure 2:
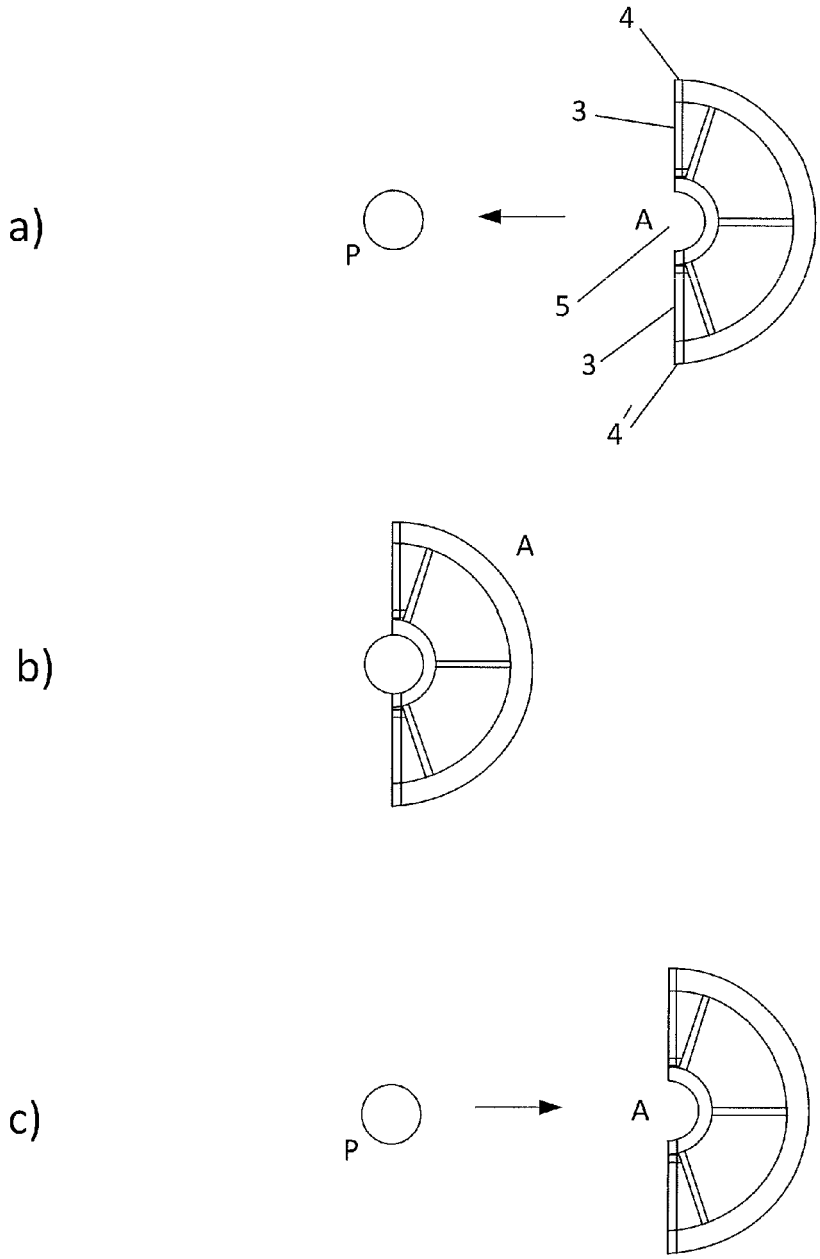
FIG. 2 shows schematically the process, according to the present invention, where a) shows the docking of a dry setting element, A, according to the present invention, on a cylindrical structure, P; b) shows the dry setting element, A, docked on the cylindrical structure, P, for inspection and/or maintenance and/or repairs thereof; and c) shows the de-docking of the dry setting element, A, from the cylindrical structure, P, subsequent to the inspection and/or maintenance and/or repairs process.

FIG. 2 shows a schematic of the process, according to the present invention, where a) shows the docking of a dry setting element, A, according to the present invention, on a cylindrical structure, P; b) shows the dry setting element, A, docked on the cylindrical structure, P, for inspection and/or maintenance and/or repairs thereof; and c) shows the de-docking of the dry setting element, A, from the cylindrical structure, P, subsequent to the inspection and/or maintenance and/or repairs process.

Dry Setting Installation

According to a second aspect of the present invention a dry setting installation (1) is provided for generating a substantially dry working space for carrying out work on part of a partially submerged structure, the dry setting installation (1) comprising a first truncated elongated oval-shaped dry setting element of said first aspect of the present invention, which with said part of a partially submerged structure is capable of forming a cofferdam round said part of said partially submerged structure.

The dry setting installation constitutes a work enclosure for servicing marine structures and may be a cofferdam. It is partially under the level of the water in which it is partially submerged and provides a substantially dry working space. It is secured to the partially submerged structure.

Process

According to a third aspect of the present invention a process is provided for the treatment of part of a partially submerged structure, said process comprising the steps of: closing the dry setting element of the first aspect of the present invention with said part of said partially submerged structure, sealing said dry setting element on said part of said partially submerged structure thereby providing a dry setting installation; pumping the water out of said dry setting installation thereby providing a cofferdam round said part of said partially submerged structure; cleaning the surface of said part of said partially submerged structure; curing said curable adhesive coating, filling said dry setting installation with water, removing said dry setting element from said part of said partially submerged structure.

The dry setting element can, for example, be operated from a motorised pontoon measuring 8 m by 25 m with during the treatment operation an overhanging superstructure requiring a total width of water of 12 m.

According to a preferred embodiment of the third aspect of the present invention, said dry setting element is mountable and removable by one or more divers, preferably a single diver.

According to a preferred embodiment of the third aspect of the present invention, said cleaning of the surface is performed with a high pressure jet of water e.g. working at a pressure of 130 to 2500 bar, preferably until a chloride concentration below 50 ppm is realised. This cleaning removes any incrustation and reduces the concentration of chlorides on the surface of the isolated structure to an acceptable level e.g. below 50 ppm. Mains water or freshwater is preferably used during the cleaning process.

According to a preferred embodiment of the third aspect of the present invention, the surface of the isolated element is blasted with fine particles, e.g. sand or other mineral, to a finish corresponding to Swedish Standard for sandblasting cast iron of Sa2.5 i.e. very thorough blast cleaning, near white metal 85% clean, the surface shall be free from visible oil, dirt and grease, from poorly adhering mill scale, rust, paint coatings and foreign matter, the metal has a greyish colour; and any traces of contamination shall be visible only as slight stains in the form of spots or stripes.

According to a preferred embodiment of the third aspect of the present invention, said dry setting installation is filled with water before said curable adhesive coating is cured.

The curable adhesive coating is preferably applied after removing fine particles from the surface and a nominal coating thickness of 400 μm applied with an airless spraying apparatus. Any major surface irregularities or joints are preferably filled with a paste e.g. HUMIDUR® epoxy paste to seal them. After visual checking of the spray work and the unhardened layer thickness, the dry setting installation is filled with water.

According to a preferred embodiment of the third aspect of the present invention, said curable adhesive coating is exclusive of solvents.

Anti-corrosion treatment with HUMIDUR® may involve, for example:

1) cleaning and removal of vegetation from the surface to be treated with a high pressure cleaner (e.g. 300 bar);
2) needle hammering and chip off scaling corrosion;
3) grit-blasting of the surface to the Swedish Standard of SA 2.5;
4) rinse with freshwater to remove the chlorides from the surface;
5) dry blasting of the surface;
6) prebrushing and/or filling of joints and seams with HUMIDOR® P (putty) or with rapidly hardening putty (compatible with the paint system) in the event of leaking;
7) airless spraying of the surface with HUMIDUR® ML (400 μm nominal layer thickness followed by visual inspection.

It is to be understood that although preferred embodiments, specific constructions and configurations, as well as materials, have been discussed herein for devices according to the present invention, various changes or modifications in form and detail may be made without departing from the scope and spirit of this invention. Steps may be added or deleted to methods described within the scope of the present invention.

The invention claimed is:

1. A dry setting element comprising:

a first end, a second end, a truncated elongated angular-, oval-, or part-angular-part-oval-shaped body having two elongated extremities extending between the first end and the second end, and a sealing means;

said first end being open and said second end being closed with a floor having a free edge;

wherein said sealing means comprises a structure having a closed part and an open part, said closed part extending a length between the open end and the closed end of said body and a width from said elongated extremities to proximal ends of the free edge of said floor, said open part adapted to accommodate part of a partially submerged structure as a closure for the dry setting element, and wherein edges of the open part comprise edges of the closed part extending between the open end and the closed end of said body and the free edge of the floor and the sealing means comprises sealing elements along the edges of said open part.

2. The dry setting element according to claim 1, wherein a plane is formed by the elongated extremities and the closed parts of the sealing means are external to the plane.

3. The dry setting element according to claim 1, wherein said dry setting element is capable of being used at ambient pressure.

4. The dry setting element according to claim 1, wherein a plane is formed by the elongated extremities and an angle between the closed parts of the sealing means and the plane is less 60°.

5. The dry setting element according to claim 1, wherein a plane is formed by the elongated extremities and an angle between the closed parts of the sealing means and the plane is less 45°.

6. The dry setting element according to claim 1, wherein a plane is formed by the elongated extremities and an angle between the closed parts of the sealing means and the plane is less 30°.

7. A dry setting installation is provided for generating a substantially dry working space for carrying out work on a partially submerged structure, the dry setting installation comprising a truncated elongated angular-, oval-, or part-angular-part-oval-shaped dry setting element capable of forming a cofferdam round a part of the partially submerged structure;

wherein said dry setting element comprises a first end, a second end, a truncated elongated angular-, oval-, or part-angular-part-oval-shaped body having two elongated extremities extending between the first end and the second end, and a sealing means;

said end being open and said second end being closed with a floor having a free edge;

wherein said sealing means comprises a structure having a closed part and an open part, said closed part extending a length between the open end and the closed end of said body and a width from said elongated extremities to proximal ends of the free edge of said floor, said open part adapted to accommodate part of the partially submerged structure as a closure for the dry setting element, and wherein edges of the open part comprise edges of the closed part extending between the open end and the closed end of said body and the free edge of the floor and the sealing means comprises sealing elements along the edges of said open part.

8. A process is provided for the treatment of part of a partially submerged structure, said process comprising the steps of:

closing a dry setting element with said part of said partially submerged structure, sealing said dry setting element on said part of said partially submerged structure thereby providing a dry setting installation;

pumping the water out of said dry setting installation thereby providing a cofferdam round said part of said partially submerged structure; cleaning the surface of said part of said partially submerged structure;

curing a curable adhesive coating, filling said dry setting installation with water, removing said dry setting element from said part of said partially submerged structure, wherein said dry setting element comprises a first end, a second end, a truncated elongated angular-, oval-, or part-angular-part-oval-shaped body having two elongated extremities extending between the first end and the second end, and a sealing means;

said end being open and said second end being closed with a floor having a free edge;

wherein said sealing means comprises a structure having a closed part and an open part, said closed part extending a length between the open end and the closed end of said body and a width from said elongated extremities to proximal ends of the free edge of said floor, said open part adapted to accommodate part of a partially submerged structure as a closure for the dry setting element, and wherein edges of the open part comprise edges of the closed part extending between the open end and the closed end of said body and the free edge of the floor and the sealing means comprises sealing elements along the edges of said open part.

9. A method for carrying out inspection and/or maintenance and/or repairs on partially submerged structures comprising:

providing a mobile dry setting installation comprising a mobile dry setting element having a first end, a second end, a truncated elongated angular-, oval-, or part-angular-part-oval-shaped body having two elongated extremities extending between the first end and the second end, and a sealing means;

said first end being open and said second end being closed with a floor having a free edge;

wherein said sealing means comprises a structure having a closed part and an open part, said closed part extending a length between the open end and the closed end of said body and a width from said elongated extremities to proximal ends of the free edge of said floor, said open part adapted to accommodate part of a partially submerged structure as a closure for the dry setting element, and wherein edges of the open part comprise edges of the closed part extending between the open end and the closed end of said body and the free edge of the floor and the sealing means comprises sealing elements along the edges of said open part; and closing the dry setting element with a part of a partially submerged structure, wherein said dry setting installation generates a substantially dry working space for carrying out work on said partially submerged structure.

* * * * *